US007332667B2

(12) United States Patent
Ueki

(10) Patent No.: US 7,332,667 B2
(45) Date of Patent: Feb. 19, 2008

(54) AUTOMATIC PERFORMANCE APPARATUS

(75) Inventor: Kazuhisa Ueki, Hamamatsu (JP)

(73) Assignee: Yamaha Corporation (JP)

( * ) Notice: Subject to any disclaimer, the term of this patent is extended or adjusted under 35 U.S.C. 154(b) by 367 days.

(21) Appl. No.: 10/751,580

(22) Filed: Jan. 5, 2004

(65) Prior Publication Data

US 2004/0139846 A1 Jul. 22, 2004

(30) Foreign Application Priority Data

Dec. 27, 2002 (JP) ..... 2002-381235

(51) Int. Cl.
*G10H 1/00* (2006.01)

(52) U.S. Cl. ..... 84/610; 84/634; 84/650; 84/666

(58) Field of Classification Search ..... 84/610, 84/634, 650, 666
See application file for complete search history.

(56) References Cited

U.S. PATENT DOCUMENTS 4,381,689 A * 5/1983 Oya ..... 84/617
5,164,531 A * 11/1992 Imaizumi et al. ..... 84/634
5,208,416 A 5/1993 Hayakawa et al. ..... 84/634
5,241,128 A * 8/1993 Imaizumi et al. ..... 84/618
5,831,195 A * 11/1998 Nakata ..... 84/609
5,850,051 A * 12/1998 Machover et al. ..... 84/634

FOREIGN PATENT DOCUMENTS

JP 11-126077 A 5/1999
JP 3303576 5/2002
JP 2002-268638 A 9/2002

OTHER PUBLICATIONS

Partial English Translation of Foreign Office Action corresponding to Japanese Patent Application No. 2002-381235.

* cited by examiner

*Primary Examiner*—Lincoln Donovan
*Assistant Examiner*—David S. Warren
(74) *Attorney, Agent, or Firm*—Rossi, Kimms & McDowell LLP

(57) ABSTRACT

An automatic performance apparatus comprises a storage device that stores performance data and accompaniment data having a plurality of sections, a detector that detects a specific note in the performance data, a reproduction device that simultaneously reproduces the performance data and the accompaniment pattern data, and a controller that controls the reproduction device to change the section at a point of the detected specific note. A musical performance that is rich in variations can be performed easily with simple automatic performance data.

6 Claims, 5 Drawing Sheets

AUTOMATIC PERFORMANCE APPARATUS

This application is based on Japanese Patent Application 2002-381235, filed on Dec. 27, 2002, the entire contents of which are incorporated herein by reference.

BACKGROUND OF THE INVENTION

A) Field of the Invention

This invention is related to an automatic music performance apparatus, and more in detail, an automatic performance apparatus having an automatic accompanying function.

B) Description of the Related Art

It is well-known that an automatic performance apparatus that can add a lacking accompanying part by reproducing simultaneously both style data (accompanying pattern data) and song data for a automatic performance such as MIDI data.

Normally a plurality of style data are provided by music genre such as rock, jazz, pops, etc., and each style data is consisted of a plurality of section data following to a progress of music such as an introduction, a main part, a fill-in, an interlude, an ending, etc.

As the automatic performance apparatus described in the above, for example, changing information for the style data that should be reproduced with the song data at the same time is set in the song data in advance, and the sections of the style data are switched in accordance with the progress of the song, i.e., song data (refer to Japanese Patent No. 3303576).

In the conventional automatic performance apparatus, it is impossible to change the sections automatically along with the progress of the song data when normal song data without the setting of the style data changing information (generally most of them are such data). Therefore, a user needs to operate a section change switch (e.g., an intro switch, an ending switch, etc.) along with the progress of the automatic performance in order to perform a song that is rich in variations. A burden of the user will be increased, and it is necessary to understand a condition of the performance (when the section is preferably changed).

SUMMARY OF THE INVENTION

It is an object of the present invention to provide an automatic performance apparatus that can easily perform a musical performance that is rich in variations with simple automatic performance data.

According to one aspect of the present invention, there is provided an automatic performance apparatus comprising a storage device that stores performance data and accompaniment data having a plurality of sections, a detector that detects a specific note in the performance data, a reproduction device that simultaneously reproduces the performance data and the accompaniment pattern data, and a controller that controls the reproduction device to change the section at a point of the detected specific note.

According to the present invention, an automatic performance apparatus that can easily perform a musical performance that is rich in variations with simple automatic performance data can be provided.

DETAILED DESCRIPTION OF THE PREFERRED EMBODIMENTS

Figure 1:
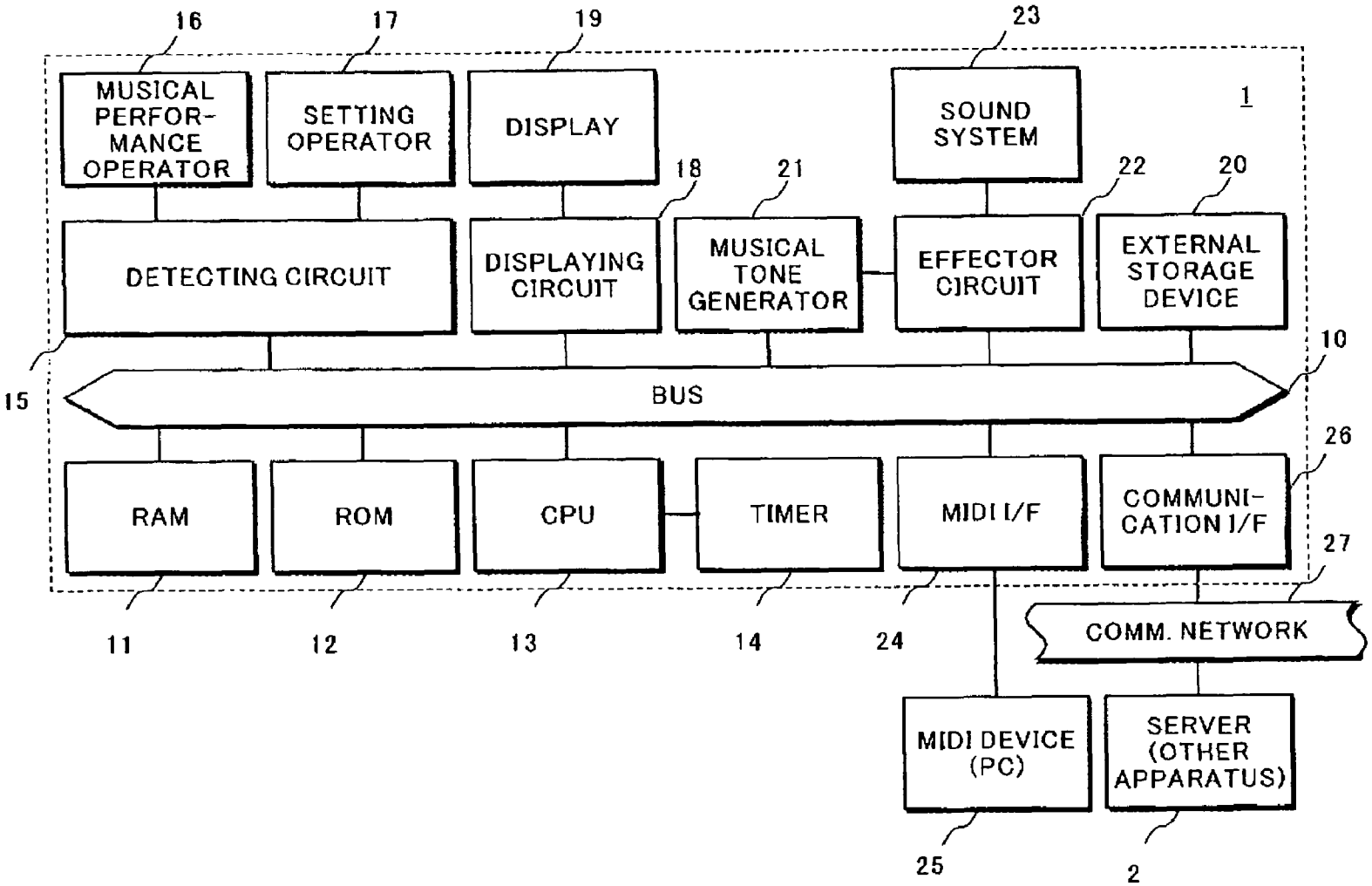
FIG. 1 is a block diagram showing a basic structure of an automatic performance apparatus 1 according to an embodiment of the present invention.

FIG. 1 is a block diagram showing a basic structure of an automatic performance apparatus 1 according to an embodiment of the present invention. The automatic performance apparatus 1 is consisted of, for example, an electronic music apparatus such as electronic musical keyboard, etc.

To a bus 10 of the automatic performance apparatus 1, a RAM 11, a ROM 12, a CPU 13, a detecting circuit 15, a displaying circuit 18, an external storage device 20, a musical tone generator 21, an effecter circuit 22, a MIDI interface (I/F) 24 and a communication interface (I/F) 26 are connected.

A user can perform various settings by using a setting operator 17 connected to the detecting circuit 15. The setting operator 17 is, for example, a rotary encoder, a switch, a mouse, an alphanumerical keyboard, a joystick, a jog shuttle, or any types of an operator that can output a signal in accordance with an operation of the user.

Further, the setting operator 17 may be a software switch displayed on a display 19 and operated by the other operator such as a mouse.

The displaying circuit 18 is connected to the display 19 and displays various information on the display 19.

The external storage device 20 includes an interface for the external storage unit and is connected to the bus 10 via the interface. The external storage device 20 is at least one of a floppy (trademark) disk drive (FDD), a hard disk drive (HDD), a magneto optical (MO) disk drive, a compact disc read only memory (CD-ROM) drive, a digital versatile disc (DVD) drive, a semiconductor memory such as a flash memory, etc.

In the external storage device 20, various parameters, various data such as a plurality of style data and song data, etc., a program for realizing this embodiment of the present invention, performance information, etc. can be stored.

The RAM 11 has a working area for the CPU 13, where a flag, a register, a reproduction buffer area, various data, etc. are stored. The ROM 12 can store various data such as a plurality of style data and song data, etc., various parameters and control programs, and a program for realizing this embodiment of the present invention. The CPU 13 executes a calculation and various controls in accordance with the control programs, etc. stored in the ROM 12 or the external storage device 20.

A timer 12 is connected to the CPU 13 and supplies a standard clock signal, interrupt process timing, etc. to the CPU 13.

The musical tone generator 21 generates a musical tone signal in accordance with the style data or the song data stored in the ROM 12 or the external storage device 20 or a performance signal such as a MIDI signal supplied from a performance operator 16 or a MIDI device 25, etc. connected to the MIDI interface 24 and supplies the generated musical tone signal to a sound system 23 via the effecter circuit 22.

The musical tone generator 21 may be of any type, such as a waveform memory type, an FM type, a physical model type, a harmonics synthesis type, a formant synthesis type, and an analog synthesizer type having combination of a voltage controlled oscillator (VCO), a voltage controlled filter (VCF) and a voltage controlled amplifier (VCA). Also, the musical tone generator 21 is not limited only to those made of hardware, but may be realized by a digital signal processor (DSP) and a micro program, by a CPU and a software program, by a sound card, or by a combination of those. Further, one musical tone generator may be used time divisionally to form a plurality of sound producing channels, or a plurality of musical tone generators may be used to form a plurality of sound producing channels by using one musical tone generator per one sound producing channel.

The effecter circuit 22 adds various musical effects to the musical tone signals supplied from the musical tone generator 22. The sound system 23 includes a D/A converter and loudspeakers, and converts supplied digital tone signals into analog tone signals to sound.

The musical performance operator 16 is connected to the detecting circuit 15 and supplies a performance signal in accordance with a musical performance of the user. As the musical performance operator 16, anything that can output a performance signal such as a MIDI signal can be used.

The MIDI interface (MIDI I/F) 24 is used for connection to other musical instruments, audio apparatuses, computers or the like, and can transmit/receive at least MIDI signals. The MIDI interface 24 is not limited only to a dedicated MIDI interface, but it may be other general interfaces such as RS-232C, universal serial bus (USB) and IEEE1394. In this case, data other than MIDI message data may be transmitted/received at the same time.

The MIDI device 25 is an audio apparatus, a musical instrument, etc. connected to the MIDI interface 24. The type of the MIDI device 25 is not limited only to a keyboard instrument, but other types may also be used, such as a stringed instrument, a wind instrument and a percussion instrument. Moreover, the MIDI device 25 is not limited only to an electronic musical instrument of the type that the components thereof such as a tone generator and an automatic performance apparatus are all built in one integrated body, but these components may be discrete and interconnected by communication devices such as MIDI and various networks. The user can also use the MIDI device 25 in order to input performance information.

The communication interface 26 can establish a connection to server computer 2 via a communication network 27 such as a local area network (LAN), the Internet, a phone line or the like and can download the control programs, the program for realizing the embodiment, the style data, the song data, etc., from the server 2 to the external storage device 20 such as a HDD or the RAM 11. Further, the communication interface 26 and the communication network 27 are not limited to be wired but also be wireless or both wired and wireless.

Figure 2A:
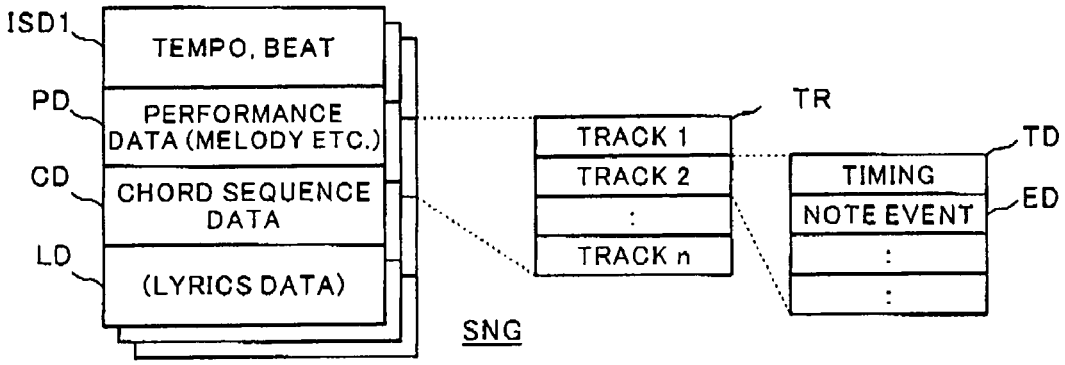
FIGS. 2A and 2B are diagrams showing formats of song data SNG and style data STL according to the embodiment of the present invention.
Figure 2B:
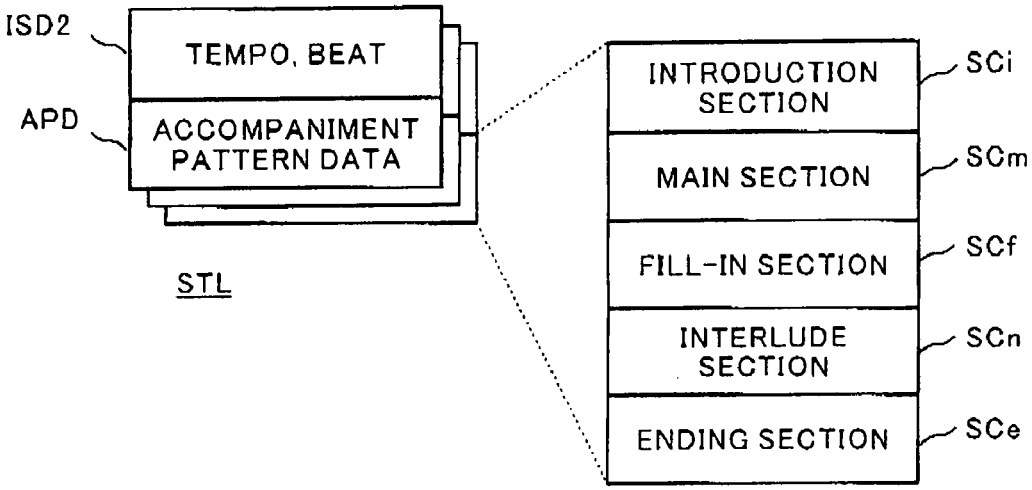

FIGS. 2A and 2B are diagrams showing formats of song data SNG and style data STL according to the embodiment of the present invention.

FIG. 2A is a diagram showing a format of the song data SNG. The song data SNG is consisted of initial setting information ISD1 including reproduction tempo of music and beat information, performance data PD having a plurality of tracks TR and chord sequence data CD representing a chord sequence of the music. Further, lyrics data LD representing lyrics of the music may be included in the song data SNG.

The performance data PD is formed including a plurality of tracks (parts) TR, and each track TR may be classified into a part, for example, a melody part, a rhythm part, etc.

Each track TR of the performance data PD includes at least timing data TD and event data ED representing an event that should be reproduced at the timing represented by the timing data TD.

The timing data TD is data representing a time for processing various events represented by the event data ED. The processing time of an event can be represented by an absolute time from a starting time of a musical performance or by a relative time that is a time elapsed from the previous event.

The event data ED is data representing a content (a type of a command) of one of various events for reproducing the music. The event may be an event directly related to the reproduction of the music such as a note event (note data) NE represented by a combination of a note-on event and a note-off event or a setting event for setting reproduction type of the music, such as a pitch change event (a pitch bend event), a tempo change event, a tone color change event, etc. Each note event NE includes a pitch, note length (a gate time), a volume (velocity), etc.

Further, the song data SNG is not limited to the format shown in FIG. 2A, but also may be automatic performance data at least including the timing data and the event data such as MIDI data based on the Standard MIDI File (SMF) file format.

FIG. 2B is a diagram showing a format of the style data STL according to the embodiment of the present invention. The style data STL is performance data for automatic accompaniment including a plurality of sections. The style data STL is consisted of accompaniment pattern data APD and initial setting information ISD2 including information of a style type, a reproduction tempo and a beat of the music.

The style type may be, for example, one of a music genre such as rock, jazz, pops, blues, etc. and a tune of the music such as "cheerful", "miserable", etc. It is preferable to prepare plural types of the style data STL for each of the music genres and tunes. Also, each style data STL stores an optimal reproducing tempo in the initial setting information ISD2. Further, the beat information of each style data STL is stored in the initial setting information ISD2. When the user designates a type such as the music genre, the beat and the tempo for a desired accompaniment, the style data matched to the designation of the user is selected.

The accompaniment pattern data APD is consisted of a plurality of section data SC including information necessary for executing the automatic accompaniment. The section data SC is formed of automatic performance data for reproducing an accompaniment with length of one to several measures (performance length shorter than a length of the music), such as an introduction section SCi, a main section SCm, a fill-in section SCf, an interlude section SCn and an ending section SCe. A format of each section data SC is the same as the performance data PD shown in FIG. 2A, and each section data SC may include a plurality of the tracks. Further, the fill-in section SCf and the interlude section SCn may be omitted.

The introduction section SCi is data for so-called introduction, that is, an accompaniment optimized for introductory part placed before the main section of the music. In this embodiment, for example, the introduction section is defined from a very beginning of the song data to a measure just before a measure having a first note event of a later-described first predetermined track (e.g., track recording a melody part) or to the measure including the first note event of the first predetermined track.

The main section SCm is data for so-called main part, that is, performance data optimized for an accompaniment of the main theme of the music. In this embodiment, for example, the main section is a section where the note event is existed in the first predetermined track (melody part).

The fill-in section SCf is "an irregular pattern" inserted between the fixed form patterns (main section) of a rhythm part, such as a drum, etc. and occasionally used just before changing a musical tone. In this embodiment, for example, when a note event is not detected in the first predetermined track (melody part) within a first predetermined period (for example, ¾ or more of one measure to less than one measure) is defined as the fill-in section.

The interlude section SCn is performance data for an accompaniment optimized for the so-called interlude section. In this embodiment, for example, when a note event is not detected in the first predetermined track (melody part) within a second predetermined period (for example, one or more than one measure) is defined as the interlude section. In addition, the first or second predetermined period in the interlude section or the fill-in section can be changed arbitrarily.

The ending section SCe is performance data for an accompaniment optimized for the so-called ending section, that is, a section performed after the performance of the theme of the music is completed. In this embodiment, for example, a section from or after a measure including the last note event of a later-described second predetermined track(s) (for example, all the tracks) is considered as the ending section.

Figure 3:
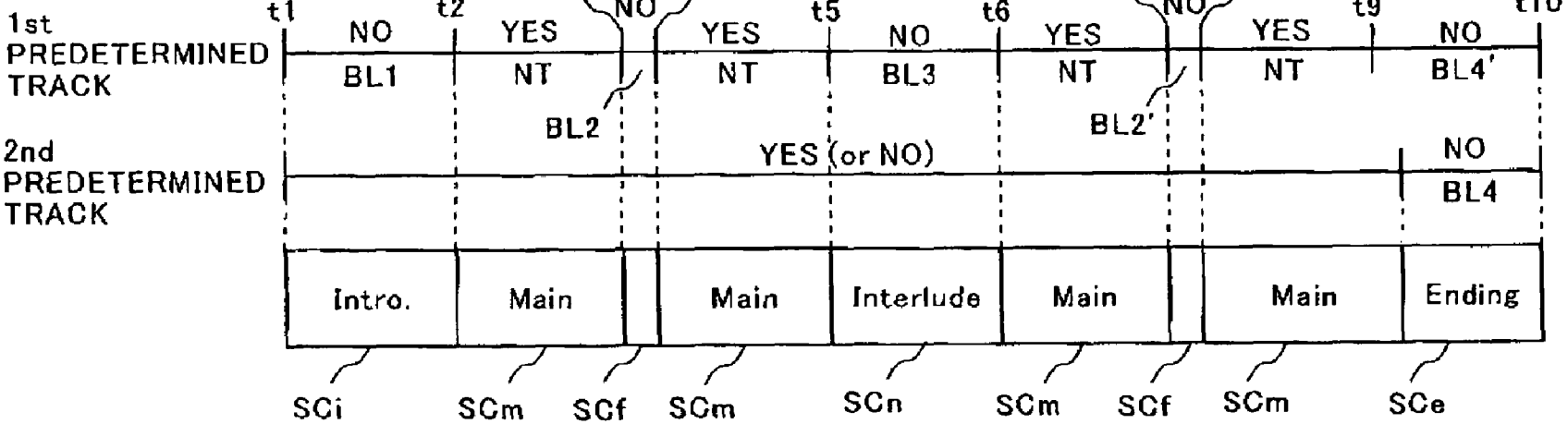
FIG. 3 is a diagram showing one example of accompaniment adding process according to the embodiment of the present invention.

FIG. 3 is a diagram showing one example of accompaniment adding process according to the embodiment of the present invention. In the drawing, a top line represent existence or inexistence of a note event in the first predetermined track selected by the user or automatically selected. A middle line represents existence or inexistence of a note event in the second predetermined track. "YES" shows the existence of the note event whereas "NO" shows the inexistence of the note event. A lower part of the drawing shows assignment of the section data SC to each section.

In addition, "the first predetermined track" and "the second predetermined track" in this specification are one or plurality of tracks selected by the user or automatically. "The first predetermined track" is a track for determining assignment of sections other than the ending section, and "the second predetermined track" is a track for determining assignment of the ending section.

When selecting "the first predetermined track" automatically, a track with the smallest track number, a track containing the note number of the highest sound, a track consisted of single sounds, etc, is selected as a melody track. In this embodiment, the melody track shall be selected as "the first predetermined track." Although it is desirable that the melody track is selected as "the first predetermined track" when selecting the accompaniment pattern data, other tracks may be selected as the first predetermined track. Moreover, since constituting one melody from two or more tracks is also considerable, two or more tracks can be selected as the first predetermined track.

Moreover, when selecting "the second predetermined track" automatically, all the tracks included in the performance data PD are selected as "the second predetermined track." In addition, although it is also considered that the same track is selected as the first and the second predetermined tracks, the selection of the second predetermined track may be omitted in that case, and the first predetermined track is used for assignment of all the sections.

An example of the assignment of the sections in this embodiment will be described with reference to FIG. 3.

First, a position (a timing) of a first note event of the first predetermined track is detected, and a measure containing the detected first note event is defined as a first note starting measure. By that, the introduction section SCi is assigned to a blank section BL1 (a section where no note event is recorded) from the starting position t1 of the song data SNG to the position t2 (i.e., a starting position of the measure containing the first note event) of the first note starting measure.

Further, the position t2 of the first note starting measure may be an end of the measure containing the detected first note event, that is, a starting point of the next measure. That is optimal for a musical piece beginning with pick up (auftakt). Also, the positioning of the position t2 at the beginning or the end of the measure can be changed automatically. In that case, for example, when the detected first note event is positioned in a first half of the measure containing the detected first note event, the beginning of the measure containing the detected first note event will be the position t2. Also, for example, when the detected first note event is positioned in a second half of the measure containing the detected first note event, the end of the measure containing the detected first note event (the beginning of the next measure of the measure containing the detected first note event) will be the position t2.

Next, blank sections BL2 and BL3 are detected from the first predetermined track. The blank section BL2 is a section, for example, where no note event exists within a relatively short period such as ¾ of a measure to less than one measure. In this example, sections from timing t3 to timing t4 and from timing t7 to timing t8 are blank sections BL2 because there are short blank sections (section with no note event) in those sections. To the blank sections BL2, the fill-in section SCf will be assigned.

The blank section BL3 is a section, for example, where no note event exists for relatively long period such as one or more than one measure. In this example, a section from timing t5 to timing t6 is defined as the blank section BL3. To the blank section BL3, the interlude section SCn will be assigned.

Next, a last note event of the second predetermined track(s) is detected, and a measure containing the detected last note event is defined as a last note measure. The beginning or the end of the last note measure is defined as a timing t9, and the ending section SCe is assigned to a section after the timing t9. The ending section SCe does not correspond with a length of the song data, and its length is from the timing t9 to the end of the ending section SCe.

Sections NT, each being placed between the blank sections BL1 and BL2, BL2 and BL3, BL3 and BL2 or BL2 and BL4, have note events in the first predetermined track; therefore, the main section SCm is assigned to the sections NT.

Figure 4A:
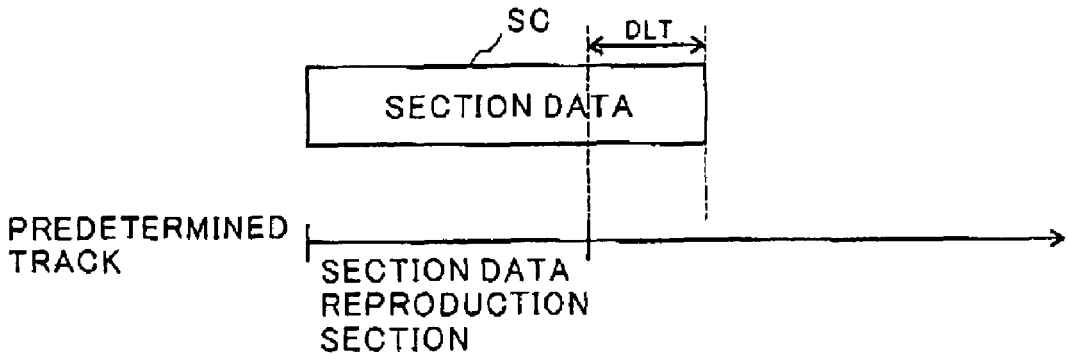
FIGS. 4A and 4B are diagrams for explaining a process when length of a reproduction section of section data does not agree with length of section data SC according to the embodiment of the present invention.
Figure 4B:
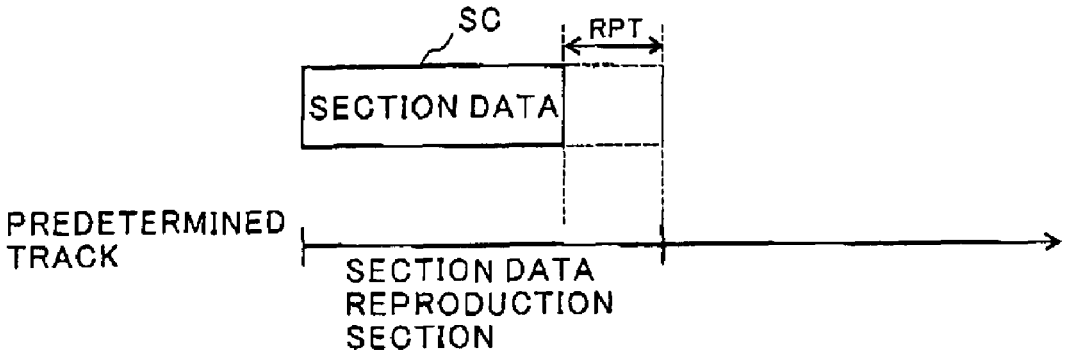

FIGS. 4A and 4B are diagrams for explaining a process when length of a reproduction section of section data does not agree with length of section data SC according to the embodiment of the present invention. Further, a section data reproducing section is a section to which either one of the introduction section SCi, the main section SCm, the fill-in section SCf, the interlude section SCn and the ending section SCe is assigned, and the section data SC is either one of the above-listed section data.

FIG. 4A shows an example when the section data reproducing section is shorter than the section data SC.

When the section data reproducing section is shorter than the section data SC, difference DLT of section lengths of the section data reproducing section and the section data SC is thinned out from the starting part or the intermediate part of the section data SC. The adjustment of the length may be executed by terminating the reproduction of the section data SC (or starting reproduction of other section data SC) just after the ending of the section data reproducing section.

FIG. 4B shows an example when the section data reproducing section is longer than the section data SC.

When the section data reproducing section is longer than the section data SC, the reproduction of the section data SC is repeated for difference RPT of section lengths of the section data reproducing section and the section data SC in order to adjust the length. Further, either one of the ending part, the intermediate part and the ending part of the section data SC may be repeated. The adjustment of the length may be executed by terminating the reproduction of the section data SC (or starting reproduction of other section data SC) just after the ending of the section data reproducing section.

Figure 5:
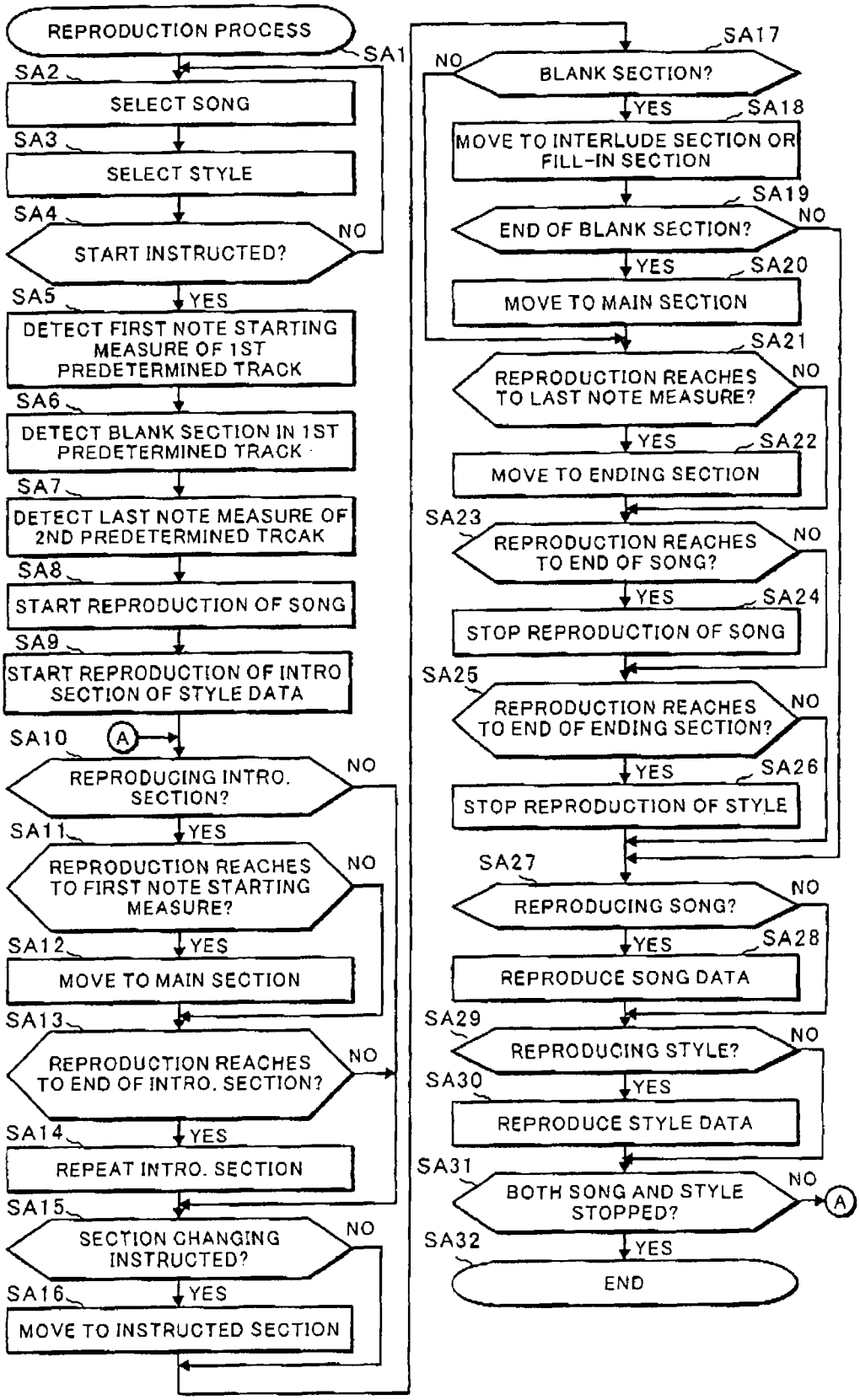
FIG. 5 is a flowchart showing a reproduction process according to the embodiment of the present invention.

FIG. 5 is a flowchart showing a reproduction process according to the embodiment of the present invention.

At Step SA1, the reproduction process is started, and at Step SA2, song data to be reproduced is selected.

At Step SA3, style data (accompanying pattern data) STL that is reproduced with the song data SNG selected at Step SA2 at the same time is selected. The style data, for example, is selected automatically by searching, from the data of style variation that agrees with music genre is selected by the user, the style data STL of which tempo and rhythm recorded in the initial setting information ISD (FIG. 2) agree with tempo and rhythm recorded in the initial setting information ISD (FIG. 2) of the selected song data SNG. Alternatively, the user may select desired style data STL arbitrary.

Moreover the song data and the style data is, for example, selected from a plurality of the song data and the style data stored in the external storing device 20 and the ROM 12 in FIG. 1. Also, when the automatic performance apparatus 1 is connected with other device such as the server 2 and the like via the communication network 27, the song data and style data stored in the server 2 can be selected.

At Step SA4, a reproduction start instruction of the selected song data SNG and the selected style data is detected. When there is the start instruction, the process proceeds to Step SA5 as indicated by an arrow marked with "YES". When there is no start instruction, the process returns to Step SA2 as indicated by an arrow marked with "NO". Moreover, the user does not need to select the song and the style at Step SA2 and Step SA3 after the first routine.

At Step SA5, a first note starting measure of a first predetermined track (melody track) of the performance data PD (FIG. 2) that is included in the selected song data SNG is detected.

At Step SA6, a blank section (section without note) of the first predetermined track of the performance data PD (FIG. 2) that is included in the selected song data SNG is detected.

At Step SA7, the last note measure of a second predetermined track (all track) of the performance data PD (FIG. 2) that is included in the selected song data SNG is detected.

Detailed explanation of the above-described processes at Steps SA5 to SA7 will be omitted with reference to the above-describe explanation for FIG. 3.

At Step SA8, reproduction of the selected song data SNG is started, and at Step SA9, reproduction of an intro-section SCi of the selected style data STL is started.

At Step SA10, it is detected whether the intro-section Sci of the style data STL is reproducing or not. When it is reproducing, the process proceeds to Step SA11 as indicated by an arrow marked with "YES". When it is not reproducing, it is judged that it is not an intro-section, and the process proceeds to Step SA15 as indicated by an arrow marked with "NO".

At Step SA11, it is judged whether the reproduction has reached to the first starting measure detected at Step SA5 or not. When it has reached to the first note starting measure, the process proceeds to Step SA12 as indicated by an arrow marked with "YES", and the reproduction of the selected style data STL is switched to the main section SCm. Moreover, as described with FIG. 4, the reproduction of the intro-section SCi may be thin out the first part and halfway part. When it has not reached to the first note starting measure yet, the process proceeds to Step SA13 as indicated by an arrow marked with "NO".

At Step SA13, it is judged whether reproduction of the intro-section SCi of the style data STL has reached to the end or not. When it has reached to the end, the process proceeds to Step SA14 as indicated by an arrow marked with "YES", and the reproduction of the intro-section is repeated as explained with FIG. 4. When it has not reached to the end yet, the process proceeds to Step SA15 as indicated by an arrow marked with "NO".

At Step SA15, it is judged whether there is a section change instruction from the user or not. When there is the section change instruction, the process proceeds to Step SA16 as indicated by an arrow marked with "YES", and the reproduction will be switched to the instructed section. When there is no instruction, the process proceeds to Step SA17 as indicated by an arrow marked with "NO".

At Step SA17, it is judged whether reproduction of the song data has reached to the blank section detected at Step SA6 or not. When the reproduction has reached to the blank section, the process proceeds to Step SA18 as indicated by an arrow marked with "YES", and the reproduction will be switched to the fill-in section SCf or the interlude section SCn in accordance with the length of the blank section. When reproduction has not reached to the blank section yet, the process proceeds to Step SA21 as indicated by an arrow marked with "NO".

At Step SA19, it is detected whether the blank section has finished or not. When the blank section has finished, the process proceeds to Step SA20 as indicated by an arrow marked with "YES", and the reproduction of the selected style data STL will be switched to the main section SCm. When the blank section has not finished yet, the process proceeds to Step SA27 as indicated by an arrow marked with "NO".

At Step SA21, it is judged whether the reproduction of the song data has reached to the last note measure detected at Step SA7 or not. When the reproduction has achieved the last note measure, the process proceeds to Step SA22 as indicated by an arrow marked with "YES", and when the reproduction has not reached to the last note measure yet, the process proceeds to Step SA23 as indicated by an arrow marked with "NO".

At Step SA23, it is judged whether the reproduction of the song data has reached to the end of the song data SNG or not. When the reproduction has reached to the end, the process proceeds to Step SA24 as indicated by an arrow marked with "YES", and the reproduction of the song data SNG is stopped. When the reproduction has not reached to the end yet, the process proceeds to Step SA25 as indicated by an arrow marked with "NO".

At Step SA25, it is judged whether the reproduction of the ending section SCe has reached to the end or not. When the reproduction has reached to the end, the process proceeds to Step SA26 as indicated by an arrow marked with "YES", and the reproduction of the style data is stopped. When the reproduction has not reached to the end yet, the process proceeds to Step SA27 as indicated by an arrow marked with "NO".

At Step SA27, it is judged whether the song data SNG is reproducing or not. When the song data is reproducing, the process proceeds to Step SA28 as indicated by an arrow marked with "YES", and the event corresponding to the present timing of the performance data PD is reproduced. When the song data is not reproducing, the process proceeds to Step SA29 as indicated by an arrow marked with "NO".

At Step SA29, it is judged whether the style data STL is reproducing or not. When the style data is reproducing, the process proceeds to Step SA30 as indicated by an arrow marked with "YES", and the event corresponding to the present timing of the section data SC is reproduced. When the style data is not reproducing, the process proceeds to Step SA31 as indicated by an arrow marked with "NO".

At Step SA31, it is judged whether the reproductions of both the song data SNG and the style data STL are stopped or not. When the reproductions of both of them are stopped, the process proceeds to Step SA32 as indicated by an arrow marked with "YES", and the reproduction process is finished. When the reproductions of both of them are not stopped (or when either one of the reproductions are not finished), the process returns to Step SA10 as indicated by an arrow marked with "NO".

According to the above-described embodiment, when the automatic performance data and the accompaniment style data are reproduced simultaneously, the position of the first note data of the automatic performance data is detected, thereafter, the first accompaniment section (the introduction section) of the accompaniment style data can be reproduced until the detected position, and the reproduction of the accompaniment can be changed to the second accompaniment section (the main section) of the accompaniment style data after the detected position. By that, a musical performance rich in a variation can be performed such as automatically changing the first accompaniment section to the second accompaniment section without user's operation of a switch.

According to the above-described embodiment, when the automatic performance data and the accompaniment style data are reproduced simultaneously, the third accompaniment section (the fill-in section) of the accompaniment style data can be reproduced in the blank section after detecting the position of the blank section of the automatic performance data. By that, a musical performance rich in a variation can be performed without user's operation of a switch.

Further, according to the embodiment, when the above-described detected blank section is longer than the predetermined time, the fourth accompaniment section (the interlude section) of the accompaniment style data can be reproduced instead of reproducing the third accompaniment section (the fill-in section). By that, a musical performance rich In a variation including the interlude section can be performed without user's operation of a switch.

According to the above-described embodiment, when the automatic performance data and the accompaniment style data are reproduced simultaneously, the position of the last note data of the automatic performance data is detected, thereafter, the second accompaniment section (the main section) of the accompaniment style data can be reproduced until the detected position, and the reproduction of the accompaniment can be changed to the fifth accompaniment section (the ending section) of the accompaniment style data after the detected position. By that, a musical performance rich in a variation can be performed such as automatically changing the second accompaniment section to the fifth accompaniment section without user's operation of a switch.

Further, a plurality of types of patterns for each of the introduction, main, fill-in, interlude and ending sections of each accompaniment pattern data may be prepared, and the pattern (the type) to be performed may be selected by the user in advance or randomly selected.

Moreover, in the above-described embodiment, correspondence of the song data and the accompaniment pattern data is automatically defined by matching of the tempo and beat. However, the present invention is not limited to that. For example, the correspondence can be defined by the user in advance, or information of the correspondence can be included in the song data or in the accompaniment pattern data.

Further, the automatic performance apparatus 1 is not limited in the form of the electronic musical instrument but also in a form of a combination of a personal computer and a software application. Also, the automatic performance apparatus 1 may be a karaoke system, a game machine, a mobile communication terminal such as a mobile phone, or an automatic performance piano, etc. When the automatic performance apparatus 1 is a mobile communication terminal, the automatic performance apparatus 1 may be consisted of a terminal and a server with a part of function.

The present invention has been described in connection with the preferred embodiments. The invention is not limited only to the above embodiments. It is apparent that various modifications, improvements, combinations, and the like can be made by those skilled in the art.

What are claimed are:

1. An automatic performance apparatus comprising:

a storage device that stores automatic performance data and accompaniment pattern data having a plurality of sections;

a detector that detects a specific note in the automatic performance data;

a reproduction device that simultaneously reproduces the automatic performance data supplied from the storage device and a section of the accompaniment pattern data; and a controller that controls the reproduction device to switch reproduction of the section of the accompaniment pattern data to another section of the accompaniment pattern data when a reproduction point of the automatic performance data by said reproduction device reaches a point corresponding to the detected specific note.

2. An automatic performance apparatus according to claim 1, wherein:

the detector detects a first note of the automatic performance data, and the controller controls the reproduction device to reproduce a first section of the accompaniment pattern data from a beginning of the automatic performance data to a top or end of a measure having the detected first note and to reproduce a second section of the accompaniment pattern data after the first section.

3. An automatic performance apparatus according to claim 1, wherein the specific note detected by the detector is a last note of the automatic performance data.

4. An automatic performance apparatus comprising:

a storage device that stores performance data and accompaniment pattern data having a plurality of sections;

a detector that detects a specific note in the performance data;

a reproduction device that simultaneously reproduces the performance data and the accompaniment pattern data; and a controller that controls the reproduction device to change the section at a point of the detected specific note, wherein the detector further detects a blank section of the performance data, and wherein the controller further controls the reproduction device to reproduce a first section for the detected blank section.

5. An automatic performance apparatus according to claim 4, wherein the controller further controls the reproduction device to reproduce a second section for the detected blank section when the detected blank section is shorter than a specific time length.

6. A computer-readable medium storing an automatic performance program comprising the instructions for:

reading automatic performance data and accompaniment pattern data having a plurality of sections from a storage device;

detecting a specific note in the automatic performance data;

simultaneously reproducing the automatic performance data supplied from the storage device and a section of the accompaniment pattern data; and controlling the reproduction device to switch reproduction of the section of the accompaniment pattern data to another section of the accompaniment pattern data when a reproduction point of the automatic performance data by said reproduction device reaches a point corresponding to the detected specific note.

* * * * *